US011407550B2

(12) United States Patent
Danielyan et al.

(10) Patent No.: US 11,407,550 B2
(45) Date of Patent: Aug. 9, 2022

(54) DUAL COMPARTMENT DISPENSER SYSTEM

(71) Applicants: Anna Danielyan, Las Vegas, NV (US); Hagop Bodosian, Las Vegas, NV (US)

(72) Inventors: Anna Danielyan, Las Vegas, NV (US); Hagop Bodosian, Las Vegas, NV (US)

(73) Assignee: STARGAZE 5 LLC, Las Vegas, NV (US)

( * ) Notice: Subject to any disclaimer, the term of this patent is extended or adjusted under 35 U.S.C. 154(b) by 0 days.

(21) Appl. No.: 16/883,476

(22) Filed: May 26, 2020

(65) Prior Publication Data

US 2020/0377254 A1 Dec. 3, 2020

Related U.S. Application Data

(60) Provisional application No. 62/920,966, filed on May 28, 2019.

(51) Int. Cl.

| | |
|---|---|
| ***B65D 85/07*** | (2017.01) |
| ***B65D 3/24*** | (2006.01) |
| ***B65D 3/04*** | (2006.01) |
| ***B65D 3/28*** | (2006.01) |
| ***B65D 43/02*** | (2006.01) |
| ***B65D 83/08*** | (2006.01) |
| ***A47K 10/42*** | (2006.01) |
| *A47K 10/32* | (2006.01) |

(52) U.S. Cl.

CPC ..... *B65D 3/24* (2013.01); *A47K 10/421* (2013.01); *B65D 3/04* (2013.01); *B65D 3/28* (2013.01); *B65D 43/0202* (2013.01); *B65D 83/0805* (2013.01); *B65D 85/07* (2018.01); *A47K 2010/3266* (2013.01); *B65D 2543/00425* (2013.01); *B65D 2543/00953* (2013.01); *B65D 2583/082* (2013.01)

(58) Field of Classification Search

CPC ..... B65D 3/24
USPC ..... 221/33–63, 101–102, 97, 256, 154
See application file for complete search history.

(56) References Cited

U.S. PATENT DOCUMENTS

| | | | | |
|---|---|---|---|---|
| 4,185,754 A * | 1/1980 | Julius | ..... | A47K 10/421 206/210 |
| 6,189,730 B1 | 2/2001 | McClymonds | | |
| 6,213,345 B1 | 4/2001 | Plank | | |

(Continued)

*Primary Examiner* — Gene O Crawford
*Assistant Examiner* — Ayodeji T Ojofeitimi
(74) *Attorney, Agent, or Firm* — Tarter Krinsky & Drogin LLP

(57) ABSTRACT

A dual compartment dispenser system is provided. The dual compartment dispenser system includes a dispenser container having a cup-shaped body including an inner volume divided equally by a divider unit into a first-compartment configured to store dry facial tissues and a second-compartment configured to store moistened towelettes. The dispenser container further features a lid including a first-aperture comprising a removable-cover and providing access to the first-compartment and a second-aperture comprising a resealable-cover and providing access to a the second-compartment. The dispenser container is sized to be stored within a cup holder of a vehicle and provides a portable and accessible dispenser container for dispensing at least one hygienic sheet product including dry facial tissues, moistened towelettes, and in certain instances disinfecting wipes.

18 Claims, 5 Drawing Sheets

(56) References Cited

U.S. PATENT DOCUMENTS

| | | | | |
|---|---|---|---|---|
| 6,279,775 | B1 | 8/2001 | Parkes et al. | |
| 6,318,590 | B1 | 11/2001 | McMurray-Stivers | |
| 6,702,147 | B2 * | 3/2004 | Ashford | A47K 10/421 221/34 |
| 7,559,434 | B2 | 7/2009 | Masting | |
| 7,694,819 | B2 * | 4/2010 | Montakhabi | A61F 5/4556 206/499 |
| 8,074,841 | B1 * | 12/2011 | Craig | B65D 25/04 222/129 |
| 8,302,810 | B2 * | 11/2012 | Mulhern | B60N 3/101 221/34 |
| 2004/0251265 | A1 | 12/2004 | Fitzsimons et al. | |
| 2011/0062178 | A1 * | 3/2011 | Godsell | B60N 3/101 221/34 |
| 2011/0204078 | A1 | 8/2011 | Mulhem et al. | |
| 2012/0298686 | A1 * | 11/2012 | Mothaffar | B65D 83/0805 221/34 |
| 2012/0311972 | A1 * | 12/2012 | Hunter | B65D 65/466 53/471 |
| 2013/0270292 | A1 * | 10/2013 | Sporre Thorburn | A47K 10/185 221/283 |
| 2014/0367400 | A1 * | 12/2014 | Grudge | B65D 83/0805 221/1 |
| 2016/0338553 | A1 | 11/2016 | Carter | |

* cited by examiner

DUAL COMPARTMENT DISPENSER SYSTEM

CROSS-REFERENCE TO RELATED APPLICATION(S)

The present application is related to and claims priority to U.S. Provisional Patent Application No. 62/920,966 filed May 28, 2019, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of dispenser containers of existing art and more specifically relates to dispensers for tissues and wipes.

RELATED ART

Dispensers with dry facial tissues and wet or pre-moistened towels have become rather common for a variety of uses ranging from personal hygiene to cleaning and sanitizing. Dry facial tissues are also often needed for a variety of reasons and purposes while traveling in a car, truck, minivan and the like. Often people in a vehicle, including the driver, need a tissue, napkin and/or wet wipe and it may be hard to access. Many people keep bundles of napkins in the glove compartment, and well-prepared people even keep a box of tissue in the car. Current dispensers are designed for placement on flat stationary surfaces such as counter tops and tables, and are not properly designed for safe, convenient, and readily accessible use in most moving vehicles. Additionally, the loose storage of napkins and tissues in glove compartments can lead to contamination of the tissues with dirt, dust, pathogens, etc. Further, the available dispensers for use in vehicles are too tall. The height interferes with the driver and/or passenger anytime they move their arm they may bump the dispenser. A suitable alternative solution is desired.

U.S. Pub. No. 2016/0338553 to Tammy Lajean Carter relates to a tissue, sanitizer wipes double dispenser, and trash bag cup. The described tissue, sanitizer wipes double dispenser, and trash bag cup includes a double dispenser comprising a cup with detachable trash bag underneath cup, also deck top container with divider down the middle of each consists of a plastic lid. The first seal is a clear plastic with lines cut to each compartment to dispense. The second is a round thicker plastic lid to cover both sides.

SUMMARY OF THE INVENTION

In view of the foregoing disadvantages inherent in the known dispenser container art, the present disclosure provides a novel dual compartment dispenser system. The general purpose of the present disclosure, which will be described subsequently in greater detail, is to provide a dual compartment dispenser system which improves accessibility to standard sanitary and hygienic accessories within an automobile, as well as promotes safety of that accessibility.

A dual compartment dispenser system is disclosed herein. The dual compartment dispenser system includes a paperboard dispenser container having a cup-shaped body including an inner volume. The cup-shaped body of the dispenser container is tapered towards a base portion of the dispenser container. The inner volume is divided equally by a divider unit into a first-compartment and a second-compartment. The dispenser container further features a lid including a first-aperture comprising a removable-cover and providing access to the first-compartment, and a second-aperture comprising a resealable-cover and providing access to the second-compartment. The resealable-cover of the second-aperture comprises pressure sensitive adhesive allowing for the resealable-cover to be removed and reattached to the lid and form a seal. The first-compartment of the dispenser container is configured to store dry facial tissues and the first-aperture is adapted to dispense the dry facial tissues individually therethrough. The second-compartment is configured to store moistened towelettes and the second-aperture is adapted to dispense the moistened towelettes individually therethrough. The second-compartment of the dispenser container features a durable wax coating for maintaining moisture within and prevent the moisture contained within from damaging the paperboard dispenser container.

The dispenser container is sized to be stored within a cup holder of a vehicle and provides a portable and accessible dispenser container for dispensing at least one hygienic sheet product including dry facial tissues, moistened towelettes, and in certain instances disinfecting wipes. The dual compartment dispenser system provides easy access to its contents from a location that can be reached by a driver without requiring the driver to direct attention away from the road.

A user may simply place the dual compartment dispenser system in the cupholder of their automobile. When a facial tissue is needed, the user may pull back and remove the removable-cover that covers the corresponding first-aperture. When a moistened towelette is needed, the user may pull back the resealable-cover, and then reapply that seal after the moistened towelette is accessed. The user can achieve this access without having to take attention away from the road, and without risk of the dual compartment dispenser system being knocked away from the cupholder.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a dual compartment dispenser system, constructed and operative according to the teachings of the present disclosure.

The various embodiments of the present invention will hereinafter be described in conjunction with the appended drawings, wherein like designations denote like elements.

DETAILED DESCRIPTION

Figure 1:
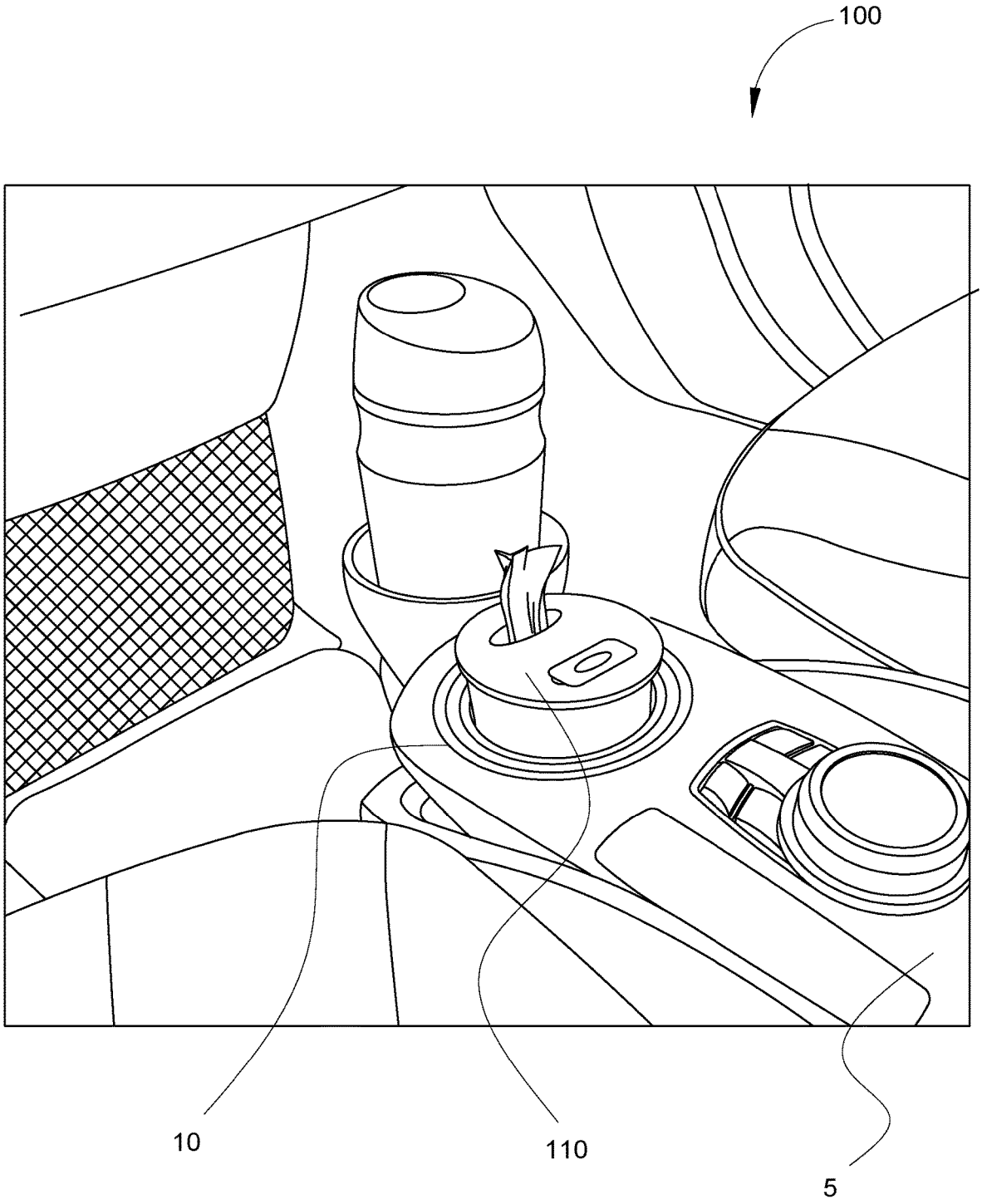
FIG. 1 is a perspective view of the dual compartment dispenser system during an 'in-use' condition, according to an embodiment of the disclosure.

As discussed above, embodiments of the present disclosure relate to a dispenser container and more particularly to a dual compartment dispenser system as used to improve the storage and dispensing of at least one hygienic sheet product including facial tissues and moistened towelettes. The dual compartment dispenser system stores facial tissues and moistened towelettes in separate compartments of the same, single container. Moistened towelettes may include disinfectant wipes.

Generally, in preferred embodiments the dual compartment dispenser system features a cylindrical, paperboard container having a lid and two compartments for separate hosting of facial tissues and moistened towelettes, and apertures through which said tissues and towelettes may be withdrawn. The container of the dual compartment dispenser system is for placement within the cupholders of an automobile (or other) and provides easy and safe access to facial tissues and moistened towelettes. The container is divided equally by a divider unit into the two compartments. A removable-cover covers the aperture through which the facial tissues are withdrawn, and an adhesive resealable-cover which covers the aperture of the moistened towelettes compartment. The moistened towelettes hosted by the dual compartment dispenser system can be resealed within their compartment, retaining their moisture, by reapplication of the resealable-cover. The area of the top surface covering the moistened towelettes may or may not be resealable. An interior plane of the resealable-cover and/or removable-cover may feature a feeding mechanism or apparatus, such as a hook, to initiate flow of the tissues/towelettes through their dispensing apertures.

The interior portion of the container that hosts the moistened towelettes preferably features a durable wax coating to protect the container from deterioration from the moisture or disinfectants on the towelettes. Both the facial tissues and moistened towelettes may be provided in a cylindrical roll of individual units, and are accessible through corresponding apertures on a top plane of the container. In a preferred version, the container measures approximately five inches in height by two and one-half inches in diameter (5"×2½") and provides a low-profile configuration to avoid disturbing a driver. The dual compartment dispenser system allows easy accessibility to its contents by passengers without disturbing drivers.

The dual compartment dispenser system effectively eliminates the dirtying and potential contamination of facial tissues that fall onto the floors of automobiles and ensures that its contents remain sanitary. By substantially ensuring that its contents remain sanitary, the dual compartment dispenser system eliminates health risks imposed on its users who would otherwise use tissues and towelettes that fell on the floor of an automobile.

In a preferred embodiment, the container is cylindrical and is made of a recyclable and/or biodegradable material such as but not limited to paperboard, chipboard, and polycaprolactone (PCL). The dual compartment dispenser system may be provided in various shapes and sizes. The dual compartment dispenser system may be made in variations that only include facial tissues and/or that only include moistened towelettes. Additionally, the dual compartment dispenser system may include various quantities of facial tissues and moistened towelettes. The dual compartment dispenser system can be made in either and/or both disposable and reusable formats. In reusable formats, either the top or bottom portion of the dual compartment dispenser system can be removable to allow insertion of new facial tissues and/or moistened towelettes.

Referring now more specifically to the drawings by numerals of reference, there is shown in FIGS. 1-5, various views of a dual compartment dispenser system 100.

FIG. 1 shows a dual compartment dispenser system 100 during an 'in-use' condition, according to an embodiment of the present disclosure. Here, the dual compartment dispenser system 100 may be beneficial for use by a user to provide a two-in-one tissue and moistened towelette dispenser device designed to conveniently and safely fit within cup holders 10, such as those within vehicles 5.

As illustrated, the dual compartment dispenser system 100 may include a dispenser container 110 having a cup-shaped body 112 including an inner volume. The inner volume is divided equally by a divider unit 116 into a first-compartment 120 and a second-compartment 130. The dispenser container 110 further features a lid 140 including a first-aperture 142 comprising a removable-cover 144 and providing access to the first-compartment 120, and a second-aperture 146 comprising a resealable-cover 148 and providing access to a the second-compartment 130. The first-compartment 120 of the dispenser container 110 is configured to store dry facial tissues 15 and the first-aperture 142 is adapted to dispense the dry facial tissues 15 individually therethrough. The second-compartment 130 is configured to store moistened towelettes 20 and the second-aperture 146 is adapted to dispense the moistened towelettes 20 individually therethrough. The dispenser container 110 is sized to be stored within a cup holder 10 of a vehicle 5 and provides a portable and accessible dispenser container 110 for dispensing at least one hygienic sheet product including dry facial tissues 15, moistened towelettes 20, and in certain instances disinfecting wipes.

Figure 2:
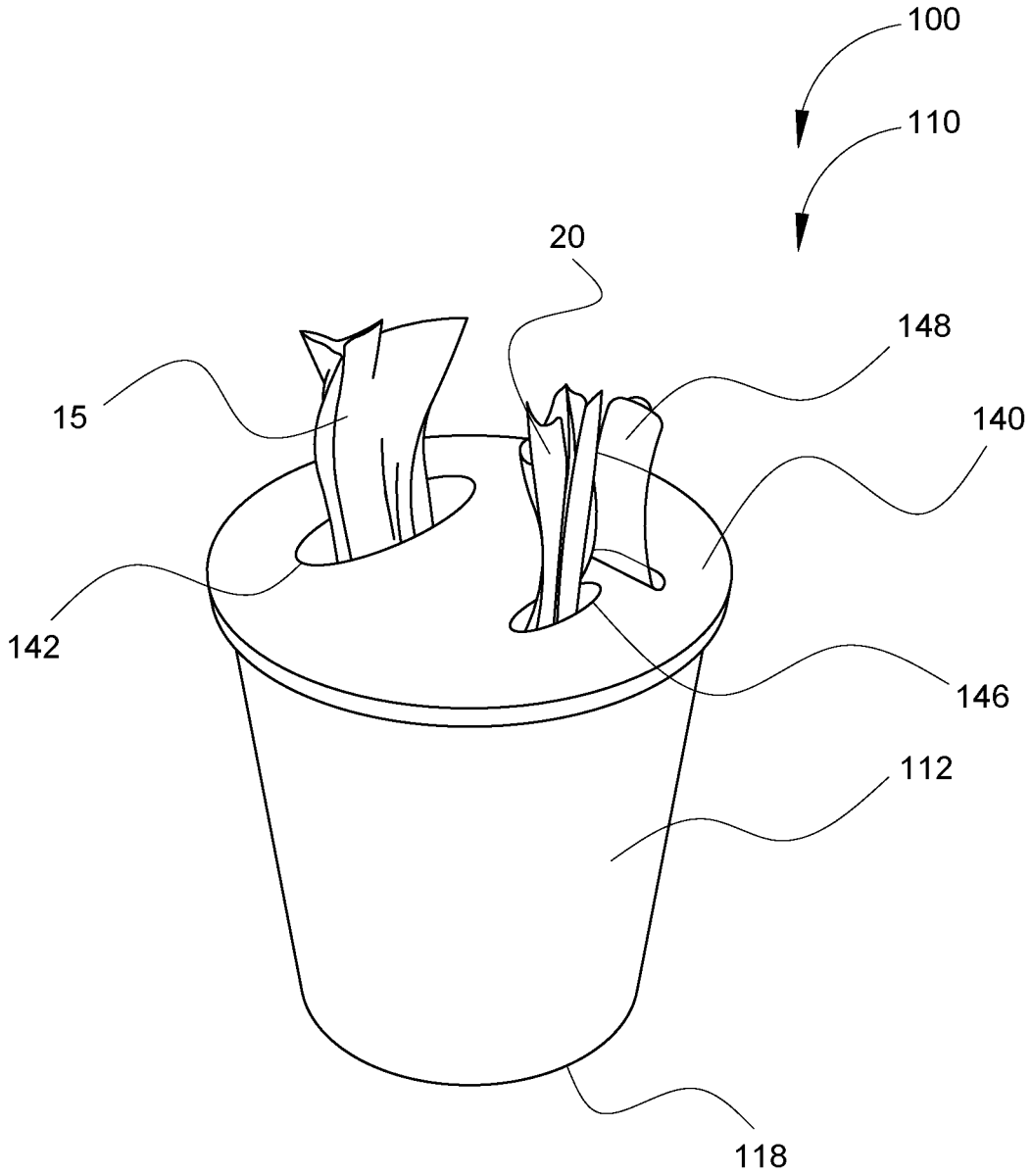
FIG. 2 is a perspective view of the dual compartment dispenser system of FIG. 1, according to an embodiment of the present disclosure.

FIG. 2 shows the dual compartment dispenser system 100 of FIG. 1, according to an embodiment of the present disclosure. As above, the dual compartment dispenser system 100 may include the dispenser container 110 having the first-compartment 120 and the second-compartment 130 configured to separately store the dry facial tissues 15 and the moistened towelettes 20 respectively. The dry facial tissues 15 and the moistened towelettes 20 are provided in a sequential continuous roll of individual the dry facial tissues 15 and the moistened towelettes 20 respectively. As shown, the dry facial tissues 15 and the moistened towelettes 20 pay be pulled through and removed from the first-aperture 142 and the second-aperture 146 accordingly, as needed. The resealable-cover 148 of the second-aperture 146 comprises pressure sensitive adhesive allowing for the resealable-cover 148 to be removed and reattached to the lid 140 and form a seal between uses. The resealable-cover 148 is provided to maintain moisture and prevent drying of the moistened towelettes 20 between uses. In certain embodiments, the removable-cover 144 and/or the resealable-cover 148 comprise a feeding-mechanism such as a hook for assisting with feeding a first of the at least one hygienic sheet product through the first-aperture 142 and the second-aperture 146 respectively after an initial removal of the removable-cover 144 and the resealable-cover 148.

Figure 3:
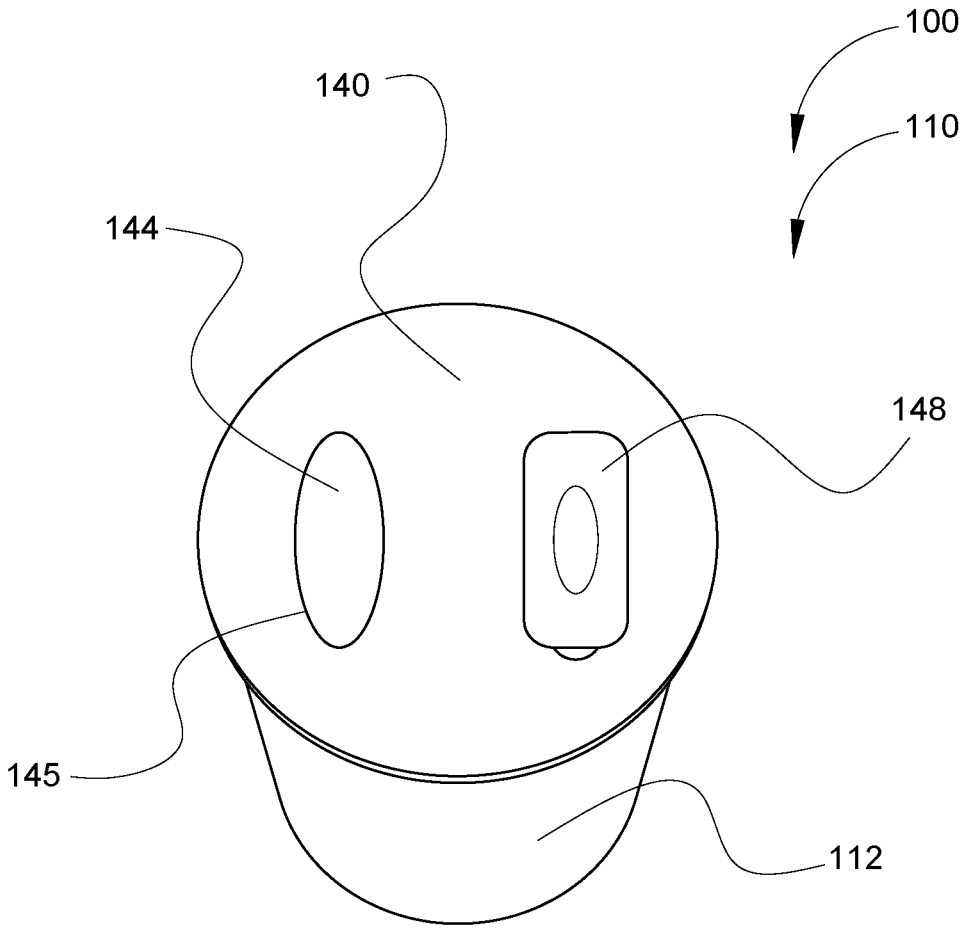
FIG. 3 is a top perspective view of the dual compartment dispenser system of FIG. 1, according to an embodiment of the present disclosure.

FIG. 3 is a top perspective view of the dual compartment dispenser system 100 of FIG. 1, according to an embodiment of the present disclosure. The dispenser container, as shown, comprises the cup-shaped body 112 and a lid 140 including the first-aperture 142 comprising the removable-cover 144, and the second-aperture 146 comprising the resealable-cover 148. The removable-cover 144 is attachable to the lid 140 at a perforated line section, the removable-cover 144 is able to be removed from the lid 140 when the perforated line section 145 is severed. Other suitable removable fastening means may be used.

As illustrated in the FIGS., the cup-shaped body 112 of the dispenser container 110 is preferably tapered towards a base portion of the dispenser container 110 such that it is able to fit within a cup holder 10. The dispenser container 110 comprises a biodegradable material, such as but not limited to paperboard, chipboard, and polycaprolactone (PCL). In a preferred embodiment, the height of the dispenser container 110 is approximately 5 inches and a diameter of the dispenser container 110 is approximately 2.5 inches providing a compact, low-profile structure. In a preferred embodiment, the dispenser container 110 is disposable and the lid 140 is fixedly attached to the dispenser container 110 however, in alternative embodiments, the dispenser container 110 may be reusable. In this embodiment, the lid 140 or base portion 118 may be removable to permit reloading the device with additional hygienic sheet product including dry facial tissues 15, moistened towelettes 20, or disinfecting wipes.

Figure 4:
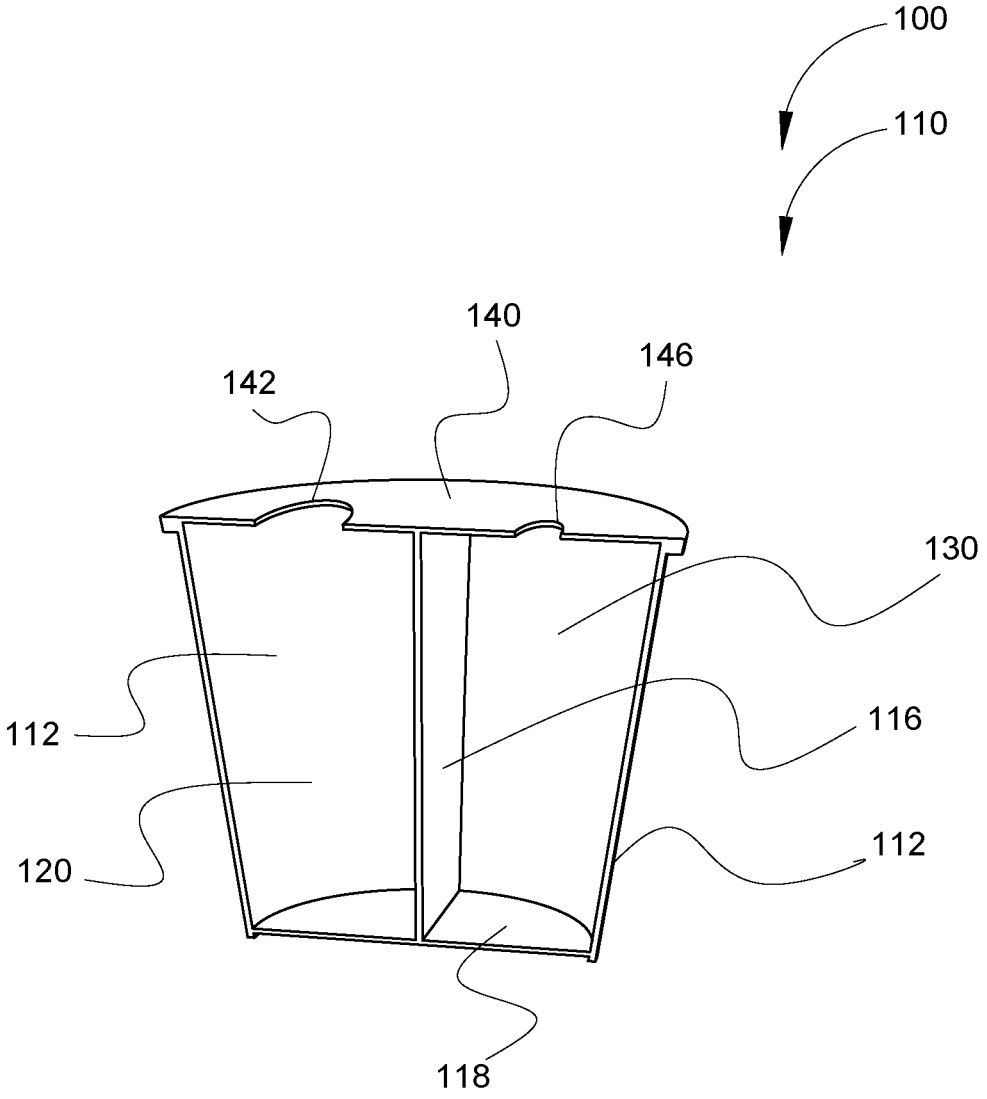
FIG. 4 is a cut away view of the dual compartment dispenser system of FIG. 1, according to an embodiment of the present disclosure.

FIG. 4 is a cut away view of the dual compartment dispenser system 100 of FIG. 1, according to an embodiment of the present disclosure. The dual compartment dispenser system comprises the dispenser container 110 having a cup-shaped body 112 separated in two equally sized compartments by the divider unit 116. The first-compartment 120 and the second-compartment 130 are formed within the inner volume of the dispenser container 110 for separately storing the dry facial tissues 15 and moistened towelettes 20. The divider unit 116 is vertically centered within this container and extends from the base portion 118 to the lid 140 of the dispenser container. A portion of an interior of the cup-shaped body 112 may include a moisture resistant coating. In a preferred embodiment, the second-compartment 130 is lined with the moisture resistant coating such as a durable wax coating to protect the dispenser container 110 from deterioration from moisture associated with the moistened towelettes 20 or disinfectants on the moistened towelettes 20.

Figure 5:
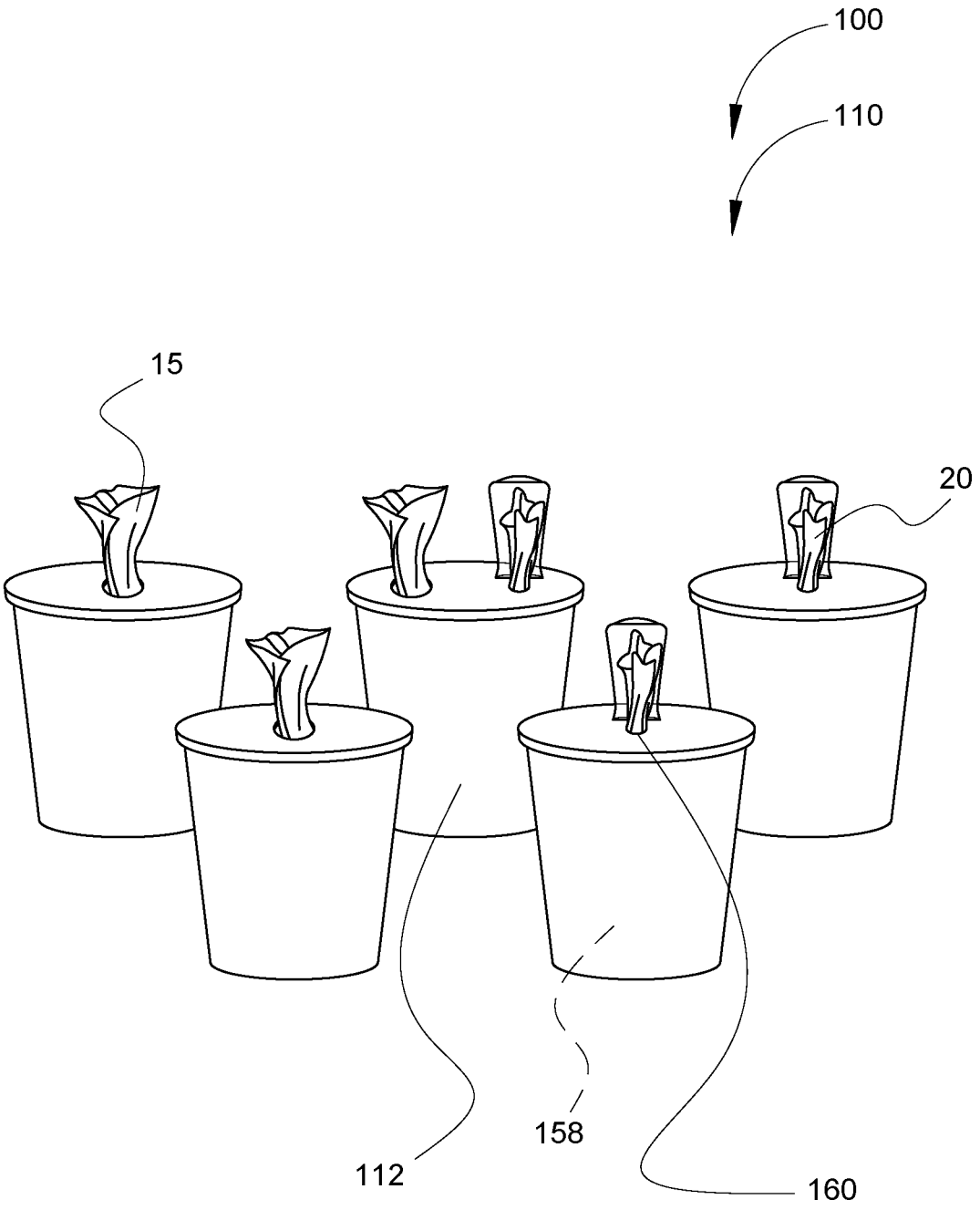
FIG. 5 is a perspective view of the dual compartment dispenser system of FIG. 1, according to an embodiment of the present disclosure.

FIG. 5 is a perspective view of the dual compartment dispenser system 100 of FIG. 1, according to an embodiment of the present disclosure. As shown in FIG. 5, the dual compartment dispenser system 100 may be provided in variations that only include dry facial tissues 15 and/or that only include moistened towelettes 20. As such, a dispenser container 110 is provided having a cup-shaped body 112 tapered towards a base portion 118 of the dispenser container 110 including an inner volume forming a storage compartment 158, a lid 140 including an aperture 160 comprising a selectively removable cover 144.

The selectively removable cover 144 when removed, either temporarily or permanently, provides access to the storage compartment 158. The storage compartment 158 of the dispenser container 110 is configured to store a hygienic sheet product. The aperture is adapted to dispense the hygienic sheet product individually therethrough. The hygienic sheet product may be provided in a sequential continuous roll of individual the hygienic sheet products such as moistened towelettes 20 or dry facial tissues 15. The dispenser container 110 is sized to be stored within a cup holder 10 of a vehicle 5 and provides a portable and accessible the dispenser container 110 for dispensing the hygienic sheet product including moistened towelettes 20 and dry facial tissues 15. The dispenser container 110 may be disposable or reusable and preferably comprises a biodegradable material.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A dual compartment dispenser system, the dual compartment dispenser system comprising:

a dispenser container having;

a cup-shaped body having an inner volume divided equally by a divider unit into a first-compartment and a second-compartment;

a lid including;

a first-aperture comprising a removable-cover providing access to said first-compartment;

a second-aperture comprising a resealable-cover and providing access to a said second-compartment;

wherein the divider unit extends vertically from a base portion of the dispenser container to the lid;

wherein said first-compartment of said dispenser container is configured to store dry facial tissues, said first-aperture is adapted to dispense said dry facial tissues individually therethrough;

wherein said second-compartment is configured to store moistened towelettes, said second-aperture is adapted to dispense said moistened towelettes individually therethrough;

wherein said dispenser container is sized to be stored within a cup holder of a vehicle; and wherein said removable-cover and said resealable-cover comprise a feeding-mechanism for assisting with feeding a first of said dry facial tissues through said first-aperture and a first of said moistened towelettes through said second-aperture respectively after an initial removal of said removable-cover and said resealable-cover.

2. The dual compartment dispenser system of claim 1, wherein said removable-cover is attachable to said lid at a perforated line section, said removable-cover is able to be removed from said lid when said perforated line section is severed.

3. The dual compartment dispenser system of claim 1, wherein said feeding-mechanism includes a hook.

4. The dual compartment dispenser system of claim 1, wherein said cup-shaped body of said dispenser container is tapered towards a base portion of said dispenser container.

5. The dual compartment dispenser system of claim 1, wherein said height of said dispenser container is approximately 5 inches and a diameter of said dispenser container is approximately 2.5 inches.

6. The dual compartment dispenser system of claim 1, wherein said moistened towelettes further includes disinfecting wipes.

7. The dual compartment dispenser system of claim 1, wherein said dry facial tissues and said moistened towelettes are each provided in a sequential continuous roll of individual said dry facial tissues and said moistened towelettes respectively.

8. The dual compartment dispenser system of claim 1, wherein said resealable-cover of the second-aperture comprises pressure sensitive adhesive allowing for said resealable-cover to be removed and reattached to said lid to form a seal.

9. The dual compartment dispenser system of claim 1, wherein said dispenser container comprises a biodegradable paperboard material.

10. The dual compartment dispenser system of claim 1, wherein a portion of an interior of said cup-shaped body includes a moisture resistant coating.

11. The dual compartment dispenser system of claim 10, wherein said portion of said interior of said cup-shaped body is said second-compartment having said moisture resistant coating.

12. The dual compartment dispenser system of claim 11, wherein said moisture resistant coating comprises a wax material coating.

13. The dual compartment dispenser system of claim 1, wherein said dispenser container is reusable.

14. The dual compartment dispenser system of claim 13, wherein said base portion of said dispenser container is removable.

15. The dual compartment dispenser system of claim 13, wherein said lid is removably attached to said dispenser container.

16. The dual compartment dispenser system of claim 13, wherein said dispenser container is disposable.

17. The dual compartment dispenser system of claim 16, wherein said lid is fixedly attached to said dispenser container.

18. A dual compartment dispenser system, said dual compartment dispenser system comprising:

a dispenser container having;

a cup-shaped body having an inner volume divided equally by a divider unit into a first-compartment and a second-compartment;

a lid including;

a first-aperture comprising a removable-cover providing access to said first-compartment;

a second-aperture comprising a resealable-cover and providing access to a said second-compartment;

wherein said first-compartment of said dispenser container is configured to store dry facial tissues, said first-aperture is adapted to dispense said dry facial tissues individually therethrough;

wherein said second-compartment is configured to store moistened towelettes, said second-aperture is adapted to dispense said moistened towelettes individually therethrough;

wherein said removable-cover and said resealable-cover comprise a feeding-mechanism for assisting with feeding a first of said dry facial tissues through said first-aperture and a first of said moistened towelettes through said second-aperture respectively after an initial removal of said removable-cover and said resealable-cover;

wherein said dispenser container is sized to be stored within a cup holder of a vehicle and provides a portable and accessible dispenser container;

wherein said dry facial tissues and said moistened towelettes are each provided in a sequential continuous roll of individual said dry facial tissues and said moistened towelettes respectively; and wherein said resealable-cover of the second-aperture comprises pressure sensitive adhesive allowing for said resealable-cover to be removed and reattached to said lid and form a seal.

* * * * *